US009990809B2

(12) United States Patent
Burnside

(10) Patent No.: US 9,990,809 B2
(45) **Date of Patent: *Jun. 5, 2018**

(54) METHOD AND APPARATUS FOR ELECTRONIC GAMING

(71) Applicant: Jack Ten Suited, Dallas, TX (US)

(72) Inventor: Robert Burnside, Houston, TX (US)

(73) Assignee: Jack Ten Suited, Dallas, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/446,859

(22) Filed: Mar. 1, 2017

(65) Prior Publication Data

US 2017/0178461 A1 Jun. 22, 2017

Related U.S. Application Data

(63) Continuation of application No. 14/020,308, filed on Sep. 6, 2013, now Pat. No. 9,600,977.

(51) Int. Cl.
*G07F 17/32* (2006.01)

(52) U.S. Cl.
CPC ..... *G07F 17/3293* (2013.01); *G07F 17/3211* (2013.01); *G07F 17/3276* (2013.01)

(58) Field of Classification Search
USPC ..... 463/11, 12, 13
See application file for complete search history.

(56) References Cited

U.S. PATENT DOCUMENTS 5,752,702 A 5/1998 McDoniel
6,375,567 B1 4/2002 Acres
6,390,474 B1 5/2002 Terminel et al.
6,416,407 B1 7/2002 Carrico et al.
6,481,717 B1 11/2002 Richardelle
6,575,831 B1 6/2003 Gonen et al.
6,902,166 B2 6/2005 Stern
(Continued)

FOREIGN PATENT DOCUMENTS

CA 2280194 A1 2/2001
CA 2632291 7/2007
(Continued)

OTHER PUBLICATIONS

Party Poker.net, Texas Hol❄ em❦ 2013 Interskill Games Limited, http://www.partypoker.net/how_to_play/poker_school/poker_games/texas_holdem.html, pp. 1-3.
(Continued)

*Primary Examiner* — Pierre E Elisca
(74) *Attorney, Agent, or Firm* — Slater Matsil, LLP

(57) ABSTRACT

A system and method for providing a card game is provided. Players are provided an option to enter one or more tournaments (for real monies or play monies). In an embodiment, a tournament lasts for a predetermined number of hands for a predetermined duration. As an example, a tournament duration may be defined by the number of players who bust out or complete a requisite number of hands by a predetermined date and time, or is defined by a specified number of players who bust out or complete the requisite number of hands. A tournament payout pool is determined based on the number of players who busted out or played in the tournament for a predetermined number of hands and duration.

20 Claims, 2 Drawing Sheets

(56) References Cited

U.S. PATENT DOCUMENTS

| | | | | |
|---|---|---|---|---|
| 2001/0004609 | A1* | 6/2001 | Walker | A63F 13/12 463/42 |
| 2003/0070178 | A1 | 4/2003 | Boyd et al. | |
| 2003/0073494 | A1 | 4/2003 | Kalpakian et al. | |
| 2004/0017043 | A1 | 1/2004 | Moody | |
| 2004/0036217 | A1 | 2/2004 | Schlumbrecht | |
| 2004/0082384 | A1 | 4/2004 | Walker et al. | |
| 2004/0132521 | A1 | 7/2004 | Peterson | |
| 2004/0183254 | A1 | 9/2004 | Schlumbrecht | |
| 2005/0116416 | A1 | 6/2005 | Peterson | |
| 2005/0215300 | A1 | 9/2005 | Oliveras | |
| 2007/0155460 | A1 | 7/2007 | Burnside et al. | |
| 2008/0280663 | A1 | 11/2008 | Shar et al. | |
| 2009/0029773 | A1* | 1/2009 | Cherry | G07F 17/32 463/42 |
| 2009/0189351 | A1 | 7/2009 | Baerlocher et al. | |
| 2010/0259005 | A1* | 10/2010 | Simon | A63F 1/00 273/292 |
| 2011/0039611 | A1* | 2/2011 | Davis | G07F 17/32 463/13 |
| 2011/0177863 | A1 | 7/2011 | Davidson et al. | |
| 2011/0275432 | A1 | 11/2011 | Lutnick et al. | |
| 2012/0058814 | A1 | 3/2012 | Lutnick et al. | |
| 2012/0214566 | A1* | 8/2012 | Suttle | G07F 17/3258 463/13 |
| 2013/0157754 | A1* | 6/2013 | Kovacs | G07F 17/3211 463/25 |
| 2014/0018137 | A1 | 1/2014 | Flaherty | |
| 2015/0072747 | A1 | 3/2015 | Burnside | |

FOREIGN PATENT DOCUMENTS

| | | | |
|---|---|---|---|
| EP | 1968720 | A2 | 9/2008 |
| WO | 9964128 | A1 | 12/1999 |
| WO | 03011407 | A1 | 2/2003 |
| WO | 2004004853 | A2 | 1/2004 |
| WO | 2004071601 | A2 | 8/2004 |
| WO | 2005033825 | A2 | 4/2005 |
| WO | 2007059310 | A2 | 5/2007 |
| WO | 2007078372 | A2 | 7/2007 |
| WO | 2009100582 | A1 | 8/2009 |

OTHER PUBLICATIONS

Party Poker.net, Omaha© 2013 Interskill Games Limited, http://www.partypoker.net/how_to_play/poker_school/ poker_games/omaha.html, pp. 1-3.

Party Poker.net, 7 Card Stud© 2013 Interskill Games Limited, http://www.partypoker.net/how_to_play/poker_school/poker_games/7cardstud.html, pp. 1-3.

Party Poker.net, 7 Card Stud Hi/Lo© 2013 Interskill Games Limited, http://www.partypoker.net/how_to_play/poker_school/poker_games/7cardstud_hi_lo.html, pp. 1-3.

Party Poker.net, Information Sheet, 2013 Interskill Games Limited, http://www.partypoker.net, pp. 1-2.

* cited by examiner

METHOD AND APPARATUS FOR ELECTRONIC GAMING

This application is a continuation application of, and claims the benefit of, U.S. patent application Ser. No. 14/020,308, filed Sep. 6, 2013, entitled "Method and Apparatus for Electronic Gaming," which application is incorporated herein in its entirety.

TECHNICAL FIELD

The present disclosure relates generally to electronic gaming devices and systems, and more particularly to a system and method for online gaming.

BACKGROUND

Many people are now playing poker on the Internet. A number of companies host games by having a website or URL, such as Party Poker and Poker Stars. The host sites generally offer a variety of games, and the number of players in a game will vary. The same type of game may be offered with a different maximum number of players. The lower the maximum number of players, the less the quality of the hand necessary to "call" and the faster the game. Where fifty-five hands an hour might be played in a nine player game, one hundred hands an hour might be played in a six player game.

A popular online poker game in the United States is Hold 'Em, and at times it comprises approximately eighty percent of the online games played. Four other popular games with a smaller percentage of the market include Four Card Omaha High, Four Card Omaha 8OB (high-low eight or better), Seven Card Stud High and Seven Card Stud 8OB. Other U.S. games comprise a smaller percentage of the market. The relative popularity of these and other games typically changes over time. There are also numerous other poker games, including foreign poker games.

There are two types of poker games: (1) the regular games and (2) the tournament games. In a regular game, if a player loses chips he may purchase additional chips and continue to play. A regular game player is free to leave the game at any time. When he quits the game, he exchanges his chips with the cashier for money. If a regular game player takes a temporarily break during the game, he is not required to ante during his break. The antes remain constant for a regular game.

Tournament game players buy an entry in the tournament for a specific amount of money and for which they receive a specific amount of chips. A tournament starts at a specific date and time or it starts when there are sufficient players to constitute the tournament. A tournament differs from a regular game in that the antes are increased periodically based on a specific time interval or the playing of a specific number of hands. Periodically increasing antes causes tournament players to be squeezed out of the tournament where eventually one player winds up with all of the chips. Tournament players are expected to continuously play except for breaks that are specifically set up so all players break at the same time. If a tournament player takes an unauthorized break, chips will be automatically deducted from his stack for antes when it is his turn to ante. The players who survive the longest receive a larger percentage of the tournament monies. The cashier will reward a certain percentage of the tournament players with the escrowed tournament money based on their ability to last the longest in the tournament. A tournament is normally completed when a specified number of players, normally one, end up with all of the chips. A tournament player can only play one entry in a tournament at any given time. He is not allowed to play multiple concurrent entries with one or multiple hands.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF ILLUSTRATIVE EMBODIMENTS

The making and using of the embodiments are discussed in detail below. It should be appreciated, however, that the present disclosure provides many applicable inventive concepts that can be embodied in a wide variety of specific contexts. The specific embodiments discussed are merely illustrative of specific ways to make and use various embodiments, and do not limit the scope of the invention.

Generally, some embodiments relate to a method or system for providing a game. As such these embodiments can be considered to relate to a device or machine system for playing a game. The game may be, for example, the game of poker or some other game in which hands are played.

Figure 1:
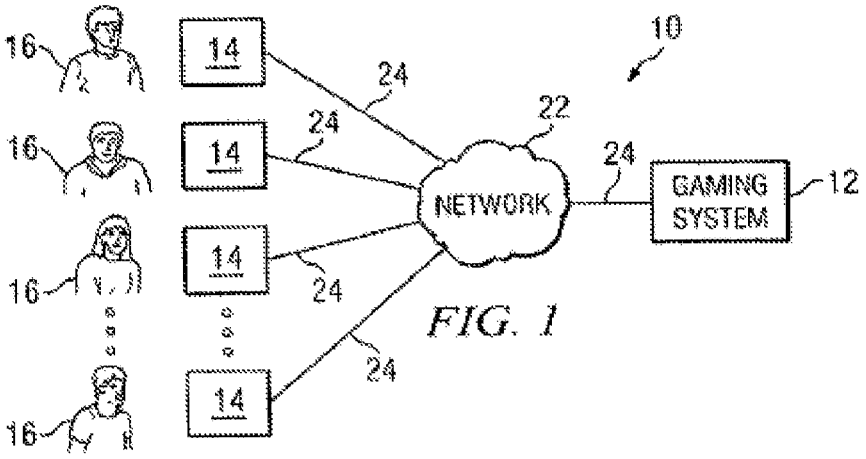
FIG. 1 illustrates a gaming network, in accordance with an embodiment.

FIG. 1 illustrates a gaming network 10, in accordance with a particular embodiment. Gaming network 10 comprises a gaming system 12 and a plurality of access elements 14. Gaming system 12 is coupled to access elements 14 through a communications network 22. Communications network 22 allows gaming system 12 and access elements 14 to communicate with each other through a plurality of communication links 24. In particular embodiments, gaming system 12 may be provided and maintained by a gaming company or organization. Access elements 14 allow users to access gaming system 12 through communication network 22.

Gaming system 12 may provide various games for play by users 16 accessing gaming system 12 through access elements 14. For example, the gaming system 12 may provide electronic poker games such as Hold 'Em, Omaha, Omaha Hi-Low, Seven Card Stud, Seven Card Stud Hi-Low, and the like. Gaming system 12 may also provide other games, including Asian and other foreign games. Users 16 may play games provided through gaming system 12 for free, for money or for various other prizes, such as coupons, discounts and merchandise. In some games, the user may bet or wager real money or points or other items with or without monetary value. In the case of wagering and playing for money, a user may deposit money in an account with gaming system 12 by check, credit card, wire transfer or any other method. Once money is in a player's account with the gaming system, the player may purchase "chips" to be used in a game, up to the amount he has on deposit.

In the illustrated embodiment, communication network 22 enables communication between access elements 14 and gaming system 12, all of which may be distributed across multiple cities and geographic regions. Network 22 may comprise one or more or partial wide area networks (WANs), public switched telephone networks (PSTNs), local area networks (LANs), the Internet or any other communications and data exchange networks or systems that enable communication between communication system elements, including public or private wireline or wireless networks. For example, in particular embodiments, some access elements 14 may communicate with gaming system 12 over the Internet, while other access elements 14 may communicate with gaming system 12 over a LAN. Network 22 may also comprise any of a number of network components to enable communication between elements as described herein. Such network components may include gate keepers, call managers, routers, hubs, switches, gateways, endpoints or other hardware, software or embedded logic implementing any number of communication protocols that allow for the exchange of data in gaming network 10. The term "communication network" should be interpreted as generally defining any network capable of transmitting audio and/or video telecommunication signals, data and/or messages. Generally, communication network 22 provides for the communication of packets, cells, frames, or other portions or data or information between and among gaming system 12 and access elements 14. In particular embodiments, communication network 22 employs communication protocols that allow for the addressing or identification of access elements, nodes and/or systems coupled to network 22. For example, using internet protocol (IP), each of the components coupled together by communication network 22 may be identified using IP addresses. In this manner, communication network 22 may support any form and/or combination of point-to-point, multicast, unicast or other techniques for exchanging media data and information among components of gaming network 10. Any network components capable of exchanging audio, video or other data using frames, packets or otherwise may be included within the scope of particular embodiments.

Access elements 14 may each be associated with one or more users of gaming system 12. Access elements 14 may include any combination of hardware, software and/or encoded logic that provides communication services to a user. For example, access elements 14 may include a telephone, a computer running telephony software, a video monitor, a personal computer, a camera, an IP phone, a cell phone, a personal digital assistant (PDA) or any other communication hardware, software and/or encoded logic that supports the communication of data or information with gaming system 12 through communication network 22. Access elements 12 may also include unattended or automated systems, gateways, other intermediate components or other devices that can establish media sessions. In particular embodiments, gaming system 12 provides a website that makes information and programming stored at gaming system 12 available to access elements 14. Access elements 14 may access gaming system 12 information, files and functionality using a Uniform Resource Locator (URL) of the website. The website may include web pages that may comprise text, images, sounds, animations and other information. In particular embodiments, access elements 14 may operate software to act as an interface between users 16 and gaming system 12. In some cases this software may generally be referred to as "thin" or "dumb" software in situations where management and control of various games resides in gaming system 12.

Communication links 24 connecting access elements 14 and gaming system 12 to network 22 may comprise any type of communication links capable of supporting data transfer, such as wireline or wireless links. In particular embodiments, communication links 24 may comprise, alone or in combination, cable links, Digital Subscriber Line (DSL) links, Integrated Services Digital Network (ISDN) links, Asymmetric Digital Subscriber Line (ADSL) links, T1 or T3 communication lines, wireless communication links, hardware lines, telephone links or other suitable types of data communication links. Communication links 24 may also connect to a plurality of intermediate servers or other components between communication network 22 and gaming system 12 and between communication network 22 and access elements 14.

Figure 2:
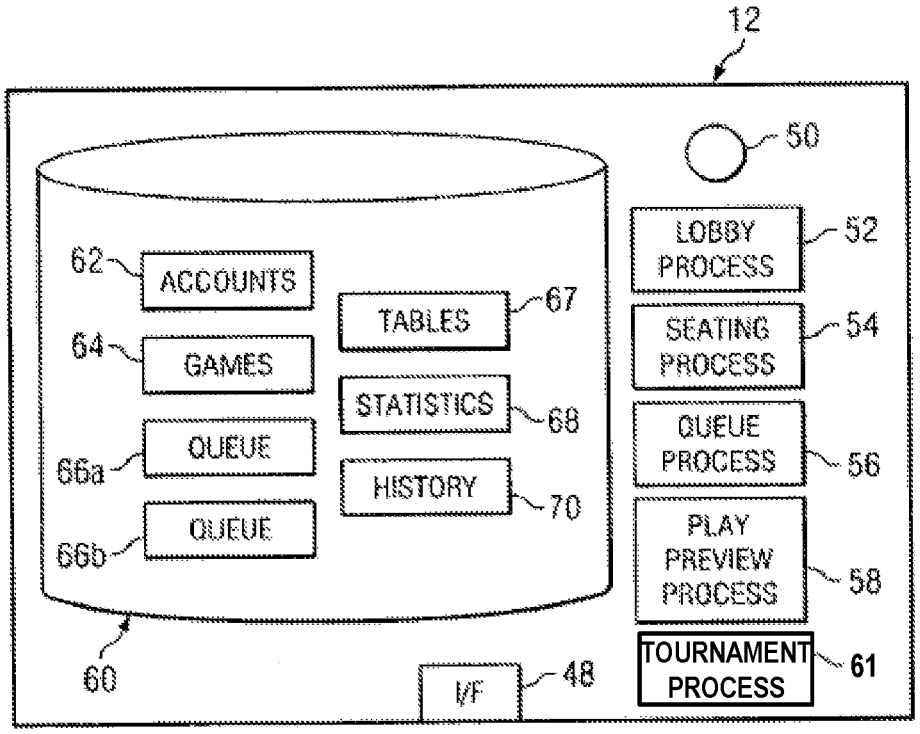
FIG. 2 illustrates a gaming system of FIG. 1, in accordance with an embodiment.

FIG. 2 illustrates gaming system 12, in accordance with a particular embodiment. Gaming system 12 includes an interface 48, a processor 50, a lobby process 52, a seating process 54, a queue process 56, a play review process 58, a tournament process 61, and a memory 60. Particular embodiments may include a gaming system having none, some, or all of the same or similar components as those described herein to perform various functionality described herein.

Interface 48 couples gaming system 12 with communication network 22 and is operable to receive communications from and transmit communications to communication network 22. Processor 50 may be a microprocessor, controller, or any other suitable computing device, resource, or combination of hardware, software and/or encoded logic operable to provide, either alone or in conjunction with other components of gaming system 12, functionality of gaming system 12. Such functionality may include controlling, managing and providing various features discussed herein to a plurality of users, such as users of access elements 14 accessing the gaming system.

Memory module 60 may be any form of volatile or non-volatile, computer-readable memory including, without limitation, magnetic media, optical media, random access memory (RAM), read-only memory (ROM), removable media, or any other suitable local or remote memory component. Memory module 60 may store any suitable data or information, including software and encoded logic, utilized by gaming system 12. In the illustrated embodiment, memory module 60 includes accounts 62, games 64, queues 66*a* and 66*b*, tables 67, statistics 68 and history 70. Gaming systems in other embodiments may include memory that includes some, none, or all of the same or similar components as those described with respect to memory module 60.

Accounts 62 generally include information relating to various players who have an account with gaming system 12. Such information may include, for example, a player's history of play, account balance (e.g., in terms of money, chips, points or otherwise), profile, current play information (e.g., table or queue status), tournament(s) status, or any other suitable information. Games 64 generally include information associated with games that may be provided through gaming system 12. Such information may include, for example, gaming software, rules, options, procedures, configurations and other information associated with games provided.

Queues 66 generally store players waiting to join tables associated with games of gaming system 12. Queues 66 may store any suitable information associated with the players in the queues, such as information described below that may be used with various queue and seating process functionality. Particular embodiments may include any suitable number and/or type of queues for various situations. For example, each queue may be associated with a particular type of game offered through gaming system 12. One of the queues may comprise player identifications who are waiting to be transferred to another table, and this queue may be referred to as the Player Transfer Queue. Tables 67 may generally include information associated with various tables of various games. For example, such information may include number of tables, current players at tables, game status information of tables, table betting parameters and any other suitable information to provide the functionality described herein.

Statistics 68 generally includes statistical information kept by gaming system 12, such as game statistics, player statistics, situational statistics related to games and/or players in various situations and any other suitable statistical information. Statistics 68 may keep detailed player statistics that help define a player's skill level, such as statistics regarding a player's aggressiveness, folding percentage and raise percentage. In some embodiments statistics for a particular player may be made available to other players either during or outside of a particular game. History 70 generally includes historical information associated with gaming system 12, such as game history, player history, recorded games and recorded hands or situations.

Lobby process 52, seating process 54, queue process 56, play review process 58, and tournament process 61 may comprise suitable hardware, software or encoded logic processes, algorithms or methods executed by gaming system 12, for example in conjunction with processor 50. Gaming systems in other embodiments may provide similar or different processes to execute some or all of the functionality described herein.

Various functionality of gaming system 12 that may be provided in one or more embodiments is described herein. This functionality may be provided in any of a number of suitable games, such as various poker games and bridge. Particular games which may benefit from embodiments described herein include games with multiple players where the play progresses serially, where there may be some idling of players and some intellectual pauses.

In particular embodiments, a user 16 may log-in to gaming system 12 by keying in a unique login name, which may ultimately be displayed at the user's selected seat at a poker table. In some embodiments, when a player indicates he wishes to play a particular game for the very first time, lobby process 52 may create a player record in accounts 62, otherwise, the lobby process 52 allows the player to select a type of game, such as Hold 'Em, Omaha, Omaha Hi-Low, Seven Card Stud and Seven Card Stud Hi-Low. The type of game may also include a betting limit, such as a $2/$4 limit game, $2/$5 no-limit game, and the like. The lobby process 52 also provides a list of available tournaments that players may enter.

The queue process 56 tracks players waiting to be seated at a table, and the seating process 54 seats a player at a particular table in accordance with the player's selection of the type of game. The manner of seating a player at a particular table may be performed in any suitable manner. For example, in an embodiment the players remain at the same table with, for the most part, the same players. Players may come and go at will. This style of play is similar to what would be experienced in a casino or home poker game or online poker games.

As another example, in an embodiment the players are moved to a new table upon folding a hand. One such method is described in U.S. Patent Application Publication No. 2007/0155460, which is incorporated herein in its entirety.

As another example, a player may be transferred according to a player's desired rate of play or on selection of a transfer option. Example methods are described in U.S. patent application Ser. No. 13/800,549 and U.S. patent application Ser. No. 13/834,037, both of which are incorporated herein in its entirety.

Play review process 58 allows player to go back and see how one or more particular hands were played. These hands may include hands that the player was involved in or hands of other players. History 70 may store the relevant game play information to make this possible. A player who just folded or otherwise completed a hand may be allowed to go back and review that hand.

Generally, a gaming system, such as the gaming system 12 discussed above, provides a method and an apparatus allowing players to play in one or more tournaments at each player's own pace. More particularly, as described in greater detail below, players are allowed to enter one or more tournaments and can come-and-go as the player chooses. Typically, tournaments comprise a number of players that begin tournament play at roughly the same time. Playing time in the tournaments are set by a strict schedule with scheduled breaks, but the players are expected to be playing during the scheduled playing time and the player's stack may be anted-off if the player is not present. The tournament pool at the end of the tournament in the typical tournament is the same as the tournament pool at the beginning of the tournament.

Additionally, embodiments such as those disclosed herein allow a player to simultaneously enter multiple tournaments. When a player enters multiple tournaments, each hand played counts as a hand played for other similar tournaments. For example, if a player enters multiple $2/$5 NLHE tournaments, then each $2/$5 NLHE hand counts as play in all $2/$5 NLHE tournaments. If the player also entered a $1/$2 NLHE or other game, play in the $2/$5 NLHE hand would not count toward the $1/$2 NLHE or other game tournaments.

Tournaments such as those disclosed herein allow a player to select a tournament by, for example, the type of game, a buy-in amount, and a duration. As an example, assume a player may select to enter a $2/$5 NLHE game with a $500 buy-in with a duration of 300 hands. Each hand the player plays counts toward the tournament performance, but the player may choose to play the 300 hands in a single session, or break the 300 hands over many separate sessions over a period of time, such as a few days or weeks. Other examples are provided below. Furthermore, as stated above, games may be played with real monies, play monies, or some arbitrary units for entertainment. For purposes of illustration, examples herein are described using play monies or real monies.

Figure 3:
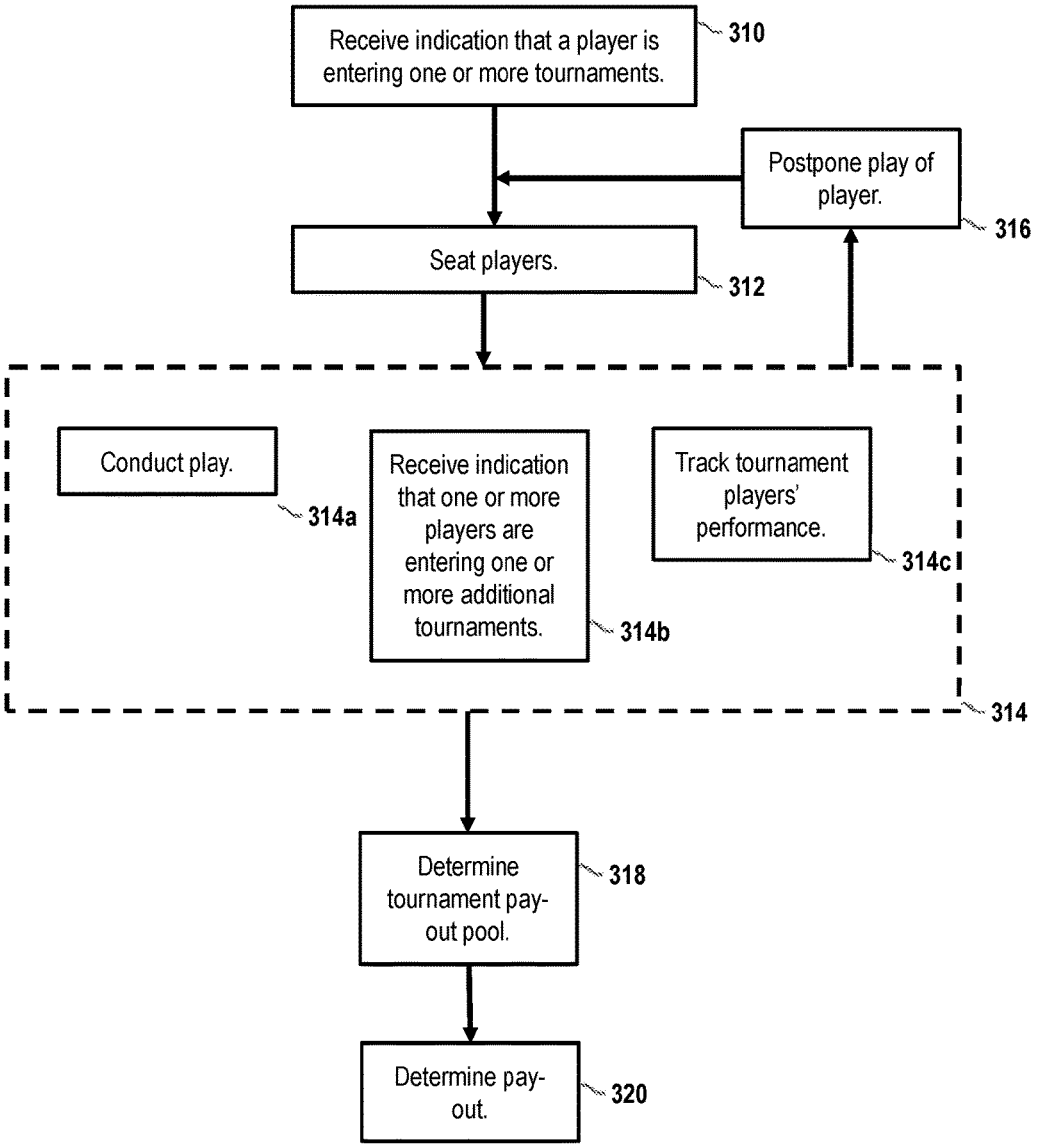
FIG. 3 is a flowchart illustrating a method for computer gaming, in accordance with an embodiment.

Referring now to FIG. 3, there is shown a method of playing a tournament in accordance with an embodiment. The process begins in step 310 wherein the gaming system 12 receives an indication that a player wishes to enter one or more tournaments. In an embodiment, the player provides via an access terminal 14 an indication of the one or more tournaments to enter. In an embodiment, the indication of a tournament received from the player includes a type of game, a buy-in amount, a selection of a number of hands to be played and a duration. The type of game may be, for example, 1/2 No-limit Hold'em (NLHE), 2/5 NLHE, 4/8 Limit Hold'em, or the like, and the buy-in amount may be, for example, $100, $200, $500, or the like. Other games and buy-in amounts may be provided, including micro-stakes and high-stakes games.

The number of hands is the number of hands that are required to complete a particular tournament.

The duration is an indication of how long the tournament lasts. In an embodiment, the duration may be unlimited, such as a duration of the first predetermined number of players to complete a selected number of hands. For example, the player may wish to play in a tournament in which the next 100, 200, 300, or the like hands played by the player counts toward the prerequisite number of hands for the tournament. The player's performance over the prerequisite number of hands is tracked and compared with a tournament payout pool (described in greater detail below) to determine and rank the player's performance.

The actual time taken for the tournament may vary, depending on how fast and often the players' play and how many players have entered the tournament. If a tournament player is not one of the first predetermined number of players to bust out or complete the prerequisite number of hands, then the player is grouped with the next predetermined number of players to complete the specified number of hands for the next like tournament. As such, the group of players in a single hand may or may not be in the same tournament pool or at the same relative point in duration. For example, in a single hand, players who have recently entered the tournament may be playing with players near completion of the tournament.

In another embodiment, the duration may be a predetermined time period or date/time. For example, the duration in this embodiment may be 5 PM on Friday. In this example, all players busting out or completing the predetermined number of hands by 5 PM Friday will be included in the tournament. If a player does not bust out or finish the predetermined number of hands by 5 PM Friday, then his tournament performance carries over to the next time period or date/time. As noted above, the tournament payout pool of the first embodiment consists of a specified number of players. In this second embodiment, the size of the tournament payout pool may vary. For example, if only ten players complete 300 hands by 5 PM Friday, then the tournament payout pool is only those ten players. If, however, 2,000 players complete 300 hands by 5 PM Friday, then the tournament pool is all 2,000 players.

For each tournament entered by the player, the player pays into a tournament prize pool an entry fee with real monies, play monies, points, and/or the like. With the payment of an entry fee, the player is provided with a predetermined number of tournament chips of an arbitrary value. It should be noted that the tournament chips may not have a value outside of the tournament. Rather, the chips are assigned an arbitrary value. For example, a player may enter a tournament by paying a $100 entry fee and receive $5,000 of tournament chips. The $5,000 of tournament chips have no monetary value outside of the tournament, but rather provides a mechanism to measure the relative sizes of stacks and bets.

In an embodiment, a player may concurrently enter the same tournament multiple times. For example, tournament rules may allow a player to enter up to 10% of the entries for a particular tournament. In this example, if a $100 entry fee tournament required 400 players to complete the tournament, a player could enter 40 current entries, or 10% of the total number of entries, provided he posted money for each tournament entry, which in this example would be $100 times 40 entries, or $4,000. In an embodiment, the player need not enter the tournament multiple times all at once. Rather, the player may enter the tournament at different points in time as long as the tournament is open to additional tournament entries.

The player's option to enter a tournament may be subject to specific rules. For example, in an embodiment, the gaming system 12 enforces a rule that for the player to enter another tournament while playing a first tournament, the player must currently have tournament chips of greater than or equal value to the original amount of tournament chips. For example, if the player bought into a 2/5 NLHE game for $200 and received $5,000 of tournament chips, the player must have $5,000 or more in tournament chips in the game to enter the second tournament. Note that the player did not receive additional chips. If the player has more than the original amount of tournament chips at the time of his entry in the second tournament, the amount of his original entry will be tracked and posted to his tournament history on a first-in, first-out (FIFO) basis such that any wager is made with tournament chips in all entered tournaments first.

In step 312, the gaming system 12, e.g., the seating process 54, seats the player at a table of like participants in accordance with any suitable system. In an embodiment, the player only plays with players who have entered the same type of game (e.g., 2/5 NLHE), bought in for the same amount (e.g., $200 buy-in), selected a same number of hands, and selected a same duration. In another embodiment, the player only plays with players who have selected the same type of game (e.g., 2/5 NLHE) and bought in for the same amount (e.g., $200), but may have selected a different number of hands and/or a different duration. In yet another embodiment, the player only plays with players who have selected the same type of game (e.g., 2/5 NLHE), bought in for the same amount (e.g., $200 buy-in), and have selected a same number of hands, but have selected a different duration. In still yet another embodiment, the player only plays with players who have selected the same type of game (e.g., 2/5 NLHE), allowing players buying in for different amounts to play each other. Other embodiments may use different criteria for seating players together. For example, players at similar levels may be grouped together, such as grouping 2/5 NLHE players buying in for $100-$1,000 together, grouping 2/5 NLHE players buying in for $25-$99 together, and the like.

Thereafter, the method proceeds to step 314, wherein the gaming system 12 conducts a tournament for the player (as illustrated by step 314*a*) and, optionally, receives an indication that the player has opted to enter one or more additional tournaments (as illustrated by step 314*b*). Step 314*b* illustrates that the gaming system 12 may optionally allow, at any time during play, a player may enter one or more additional tournaments (including entering the current tournament again and have that player's performance going forward to count toward the newly entered tournament(s).

Once entered into a tournament, the gaming system 12, e.g., the tournament process 61, tracks the player's performance as indicated by step 314*c*. The tournament player's performance may be tracked in any suitable manner. In an embodiment, the player's performance is tracked by the value of the chips (representing real monies, play monies, or some arbitrary value). It should be noted that the player may begin with a stack of tournament chips having a different value of the chips for the designated tournament.

For example, assume that a player enters a first tournament for a 2/5 NLHE game with a $200 buy-in and is provided $5,000 of tournament chips. After playing a number of hands has a stack of tournament chips worth $8,000. At this time, the player opts to enter a second tournament for a 2/5 NLHE game with a $200 buy-in for a predetermined number of hands. Thus, the player enters the second tournament when the player has chips worth more than the original amount of tournament chips. In this situation, the gaming system 12 tracks the player's tournament performance in the second tournament separate from the first tournament.

For example, if a player entered a first tournament for a 1/2 NLHE game with a $200 buy-in for $5,000 of tournament chips, and the player increased the stack of tournament chips to $8,000, upon entering a second tournament with a $200 buy-in, the first $5,000 of the tournament chips wagered represent wagers in the first tournament and the second tournament. Any wager made by the player with the chips placed into the hand's pot and on a FIFO basis the chips represent tournament chips for the most recent tournament(s) entered. Players may wager more than the total value of tournament chips for the second tournament and if they lose, then they are left with no tournament chips for the second tournament, although they may have remaining chips in the first tournament.

Continuing with the above example, assume a player entered into a 2/5 NLHE tournament with $5,000 of tournament chips, built his stack to $8,000, and then enters a second tournament. If that player wages $1,000 on the first hand and wins, the player now has $9,000 allocated in the first tournament and $6,000 allocated to the second tournament. If that player had lost the hand, the stack for the first tournament would be $7,000 and the stack for the second tournament would be $4,000.

As another example, assume again that a player entered a first tournament for a 2/5 NLHE game with a $200 buy-in for $5,000 of tournament chips, built his stack to $8,000, and then enters a second tournament. If that player wagers $5,000 on the first hand and wins, the stack for the first tournament is now $13,000 and the stack for the second tournament is $10,000. If that player instead loses, then the player busts out of the second tournament losing his entire stack of tournament chips for the second tournament, but he would retain $3,000 of chips in the first tournament.

As yet another example, assume again that a player entered a first tournament for a 2/5 NLHE game with a $200 buy-in for $5,000 of tournament chips, built the stack to $7,000, and then enters a second tournament. If that player bets $6,000 on the first hand and wins, the stack for the first tournament is now $13,000 and the stack for the second tournament will be $10,000. The stack for the second tournament is $10,000 because the stack for the second tournament was previously only $5,000, so the first $5,000 of the $6,000 bet is applied to the second tournament because the tournament chips are wagered first on a FIFO basis. If that player instead loses, then the player busts out of the second tournament, losing his entire stack of chips allocated to the second tournament, but would he retain $1,000 of chips in the first tournament.

Referring back to FIG. 3 and as indicated by step 316, players may come and go from the tournaments. Previously, tournaments were held at specific times for a specific duration with scheduled break times. Tournament players were expected to play during the scheduled times and the player's chips may be reduced with antes/blinds during the scheduled playing times regardless whether or not the player is present.

Embodiments such as those disclosed herein allow tournament players to come and go as desired. The status of the tournament players, such as tournament type, buy-in, entry fee, chip status, and the like, is saved in, for example, the games 64, statistics 68, and history 70 of the memory 60. When a player returns, the corresponding status information is retrieved and the tournament player is placed at a table in a similar manner. For example, if the player entered a tournament associated with a $200 buy-in into a 2/5 NLHE game, then the player is seated at a table in which all players originally bought into a $200 buy-in 2/5 NLHE game, regardless of the current number of chips or the relative status in the tournament(s) in terms of completing the tournament, e.g., such as the number of hands played.

Upon busting out or completing the requisite number of hands for the selected tournament, the method proceeds to step 318, wherein the tournament payout pool is determined by, for example, the tournament process 61. In an embodiment, the tournament payout pool is dependent upon the duration of the tournament entered. For example, if the duration of the tournament was based on a predetermined number of players busting out or completing a requisite number of hands, then the tournament payout pool comprises the first predetermined number of players completing the requisite number of hands (or busting out) as determined by the date-time stamp of the last hand played by each player. Players not in the first predetermined number of players will be grouped with the next group of predetermined number of players.

In an embodiment in which the duration is determined by predetermined date/time, the tournament payout pool is all players busting out or completing the requisite number of hands by the predetermined date/time. For example, if a player enters a 2/5 NLHE game with a $200 buy-in tournament that is to be completed by 5 P.M. Friday, then all players completing the requisite number of hands by 5 P.M. Friday will be in the tournament payout pool. In this example, the tournament payout pool may comprise any number of players. Players not completing the requisite number of hands by 5 P.M. Friday, will be included in the next tournament payout pool, such as the next Friday at 5 P.M.

In another embodiment, the duration is specified as a time period, such as within a 24-hour period, a 48-hour period, or the like. For example, if a player enters a 2/5 NLHE game with a $200 buy-in tournament that is to be completed between 5 P.M. Friday and 5 P.M. the next day, then all players busting out or completing the requisite number of hands within that time period will be in the tournament payout pool. In this example, the tournament payout pool may comprise any number of players. Players not busting out or completing the requisite number of hands within the predetermined time period, will be included in the next tournament payout pool, such as the next at 5 P.M. the day after next.

Thereafter, the method proceeds to step 320, wherein payout for each player is determined. Within each tournament payout pool, the players are ranked relative to each other and the tournament prize pool is paid out according to a predetermined payout schedule.

As noted above, in an embodiment the tournament chips provided to a player upon entering a tournament have no value and are not redeemed if the player decides to quit the tournament. In another embodiment, the tournament chips may have a value, allowing a player to cash-out and redeem the tournament chips for a cash payment. For example, a player may pay $50 for $5,000 of chips. In this example, the redeemable value of the chips is one-hundredth of the value of the tournament chips. If the player plays a few hands and builds his stack to $8,000, the player may opt to cash out and receive $80. In this situation, a player who cashes out may be considered as busted out for the purposes of the tournament.

In an embodiment, the $50 paid for the redeemable chips is separate from the tournament funds such that the $50 fee for the redeemable chips is not paid into the prize pool. If the player cashes out, the player forfeits any opportunity to receive a portion of the prize pool.

Optionally, the gaming system may enforce rules on the ability of a player to cash out of a tournament. For example, in an embodiment the gaming system only allows a player to cash out before playing a predetermined percentage of hands in the tournament. For example, if a player enters a tournament comprising 300 hands, the gaming system may enforce a rule that the player must cash out prior to playing 50%, or 150 hands. Similarly, another rule may be that the player must play at least a certain number of hands, such as 25% or 75 hands in this example.

In an embodiment, the player is able to cash out at any time. For example, in an embodiment, the winner of a tournament with redeemable chips will be provided the allotted portion of the tournament prize pool as well as the redeemable value of the chips.

In an embodiment, players playing with redeemable chips are seated with other like players. For example, in an embodiment players buying playing a 2/5 NLHE game with a $200 buy-in amount and a $50 fee for $5,000 of redeemable tournament chips would only play with other such players. As discussed above, players may be grouped together into various categories in other embodiments.

Although the present invention has been described in detail with reference to particular embodiments, it should be understood that various other changes, substitutions, and alterations may be made hereto without departing from the spirit and scope of the present invention. For example, although the present invention has been described with reference to a number of elements included within a gaming system, these elements may be combined, rearranged or positioned in order to accommodate particular operational configurations or needs. In addition, any of these elements may be provided as separate external components to the gaming system where appropriate. The present invention contemplates great flexibility in the arrangement of these elements as well as their internal components.

Numerous other changes, substitutions, variations, alterations and modifications may be ascertained by those skilled in the art and it is intended that the present invention encompass all such changes, substitutions, variations, alterations and modifications as falling within the spirit and scope of the appended claims. Moreover, the present invention is not intended to be limited in any way by any statement in the specification that is not otherwise reflected in the claims.

What is claimed is:

1. A method comprising:

seating, by a computerized gaming system, a plurality of players at a virtual table, a first player of the plurality of players simultaneously playing in multiple tournaments, the first player playing in more simultaneous tournaments than a second player of the plurality of players; and providing, by the computerized gaming system, a first hand to each of the plurality of players, wherein the first hand is simultaneously played in each of the multiple tournaments.

2. The method of claim 1, wherein the first hand comprises a set of cards in a hand of Hold 'Em.

3. The method of claim 1, wherein the first hand comprises a set of cards in a hand of Omaha.

4. The method of claim 1, wherein completion of a first tournament of the multiple tournaments is based on a specific number of tournament players busting out or completing a predetermined number of hands.

5. The method of claim 1, wherein completion of a first tournament of the multiple tournaments is based on players busting out or completing a predetermined number of hands within a time interval.

6. The method of claim 1, further comprising postponing play by the first player for a time period without penalty.

7. The method of claim 1, wherein each tournament of the multiple tournaments are of a same type of tournament.

8. The method of claim 1, further comprising, after providing the first hand, receiving an indication that the first player is entering an additional tournament.

9. A method comprising:

providing, by a computerized gaming system, one or more cards to a first player and a second player in a first hand of a card game;

receiving, by the computerized gaming system, an indication that the first player has entered multiple tournaments, the first hand counting toward play in each of the multiple tournaments;

determining, by the computerized gaming system, a winner of the first hand; and tracking, by the computerized gaming system, a performance of the first player in each of the multiple tournaments.

10. The method of claim 9, further comprising determining that the first player and the second player are in different tournament payout pools.

11. The method of claim 9, wherein completion of a first tournament of the multiple tournaments is based on a specific number of tournament players busting out or completing a predetermined number of hands.

12. The method of claim 9, wherein completion a first tournament of the multiple tournaments is based on players busting out or completing a predetermined number of hands within a time interval.

13. The method of claim 9, wherein if a first tournament of the multiple tournaments ends and the first player has not completed a predetermined number of hands, the first player and a play history of the first player is transferred to a next tournament.

14. The method of claim 9, further comprising postponing play by the first player for a first time period without penalty.

15. The method of claim 9, wherein the multiple tournaments comprise multiple entries in a same tournament.

16. The method of claim 9, wherein a first tournament of the multiple tournaments is for a first duration, a second tournament of the multiple tournaments is for a second duration, the first duration being different than the second duration.

17. The method of claim 9, further comprising, after completing the first hand, receiving an indication that the first player is entering an additional tournament.

18. A method comprising:

providing, by a computerized gaming system, one or more cards to a first player and a second player in a first hand of a card game, the first player playing in a first tournament, the second player playing in a second tournament, wherein a duration of the first tournament is different than a duration of the second tournament; and determining, by the computerized gaming system, a winner of the first hand, the first hand being used to determine a performance of the first player in the first tournament and used to determine a performance of the second player in the second tournament.

19. The method of claim 18, wherein the duration of the first tournament is a number of hands played.

20. The method of claim 19, wherein the duration of the second tournament is not based on a number of hands played.

* * * * *